US006363228B1

(12) United States Patent
Ream

(10) Patent No.: US 6,363,228 B1
(45) Date of Patent: Mar. 26, 2002

(54) TRANSFER BELT IMAGE REGISTRATION CORRECTION, OPERATING PARAMETERS AND LIFE VIA STORED PARAMETERS

(75) Inventor: Gregory Lawrence Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/616,749

(22) Filed: Jul. 14, 2000

Related U.S. Application Data

(63) Continuation-in-part of application No. 09/398,617, filed on Sep. 17, 1999, now Pat. No. 6,198,897.

(51) Int. Cl.[7] ..... G03G 15/16; G03G 15/01

(52) U.S. Cl. ..... 399/66; 399/88; 399/121; 399/302

(58) Field of Search ..... 399/66, 88, 297, 399/298, 303, 302, 308, 312, 313, 121

(56) References Cited

U.S. PATENT DOCUMENTS

| | | | | |
|---|---|---|---|---|
| 4,873,541 A | * | 10/1989 | Hirose et al. | 399/121 X |
| 4,912,512 A | | 3/1990 | Midorikawa | |
| 5,091,654 A | | 2/1992 | Coy et al. | 250/559.29 |
| 5,252,838 A | | 10/1993 | Timblin | 250/559.3 |
| 5,272,503 A | | 12/1993 | LeSueur et al. | |
| 5,278,625 A | | 1/1994 | Charnitski et al. | |
| 5,291,392 A | | 3/1994 | Gerber et al. | 700/56 |
| 5,325,154 A | | 6/1994 | Tayama et al. | |
| 5,337,136 A | * | 8/1994 | Knapp et al. | 399/302 X |
| 5,452,073 A | | 9/1995 | Kataoka | |
| 5,555,084 A | | 9/1996 | Vetromile et al. | |
| 5,587,783 A | | 12/1996 | Nakamura et al. | |
| 5,732,162 A | | 3/1998 | Curry | 358/428 X |
| 5,768,671 A | | 6/1998 | Komiya et al. | 399/301 |
| 6,088,565 A | * | 7/2000 | Jia et al. | 399/302 |

FOREIGN PATENT DOCUMENTS

| | | | |
|---|---|---|---|
| JP | 2-127665 | * | 5/1990 |
| JP | 3-223779 | * | 10/1991 |
| JP | 5-19639 | * | 1/1993 |
| JP | 9-230720 | * | 9/1997 |
| JP | 11-2968 | * | 1/1999 |
| JP | 2000-147961 | * | 5/2000 |

* cited by examiner

*Primary Examiner*—Susan S. Y. Lee
(74) *Attorney, Agent, or Firm*—John J. McArdle, Jr.; Michael T. Sanderson; Gordon R. Moriarty

(57) ABSTRACT

A method and apparatus for providing transfer quality optimization in printers is disclosed. A transfer belt subassembly includes a transfer belt and a storage device. The transfer belt also includes a home position indicator. The transfer belt subassembly is measured and characterized relative to the home position indicator before being installed in a printer. The measurement and calibration data for the transfer belt is then stored in the storage device that is part of the transfer belt subassembly. When the transfer belt subassembly is inserted into a printer, a controller within the printer is placed in communication with the storage device. A sensor is used to determine the home position of the transfer belt from the indicator, and a resulting signal indicating when the belt is at the home position is provided to the controller. The controller utilizes the measurement and calibration data from the storage device to provide correction with respect to each color station of the color printer, taking into account and compensating for variations in the transfer belt subassembly. In such a manner, the measurement and calibration data is predetermined before the transfer belt subassembly is inserted into the printer, thereby simplifying the printer composition. By use of the calibration and measurement data, precise alignment of the color planes with respect to one another is achieved, and the proper electrical transfer setting suited to that belt is obtained for improved transfer quality.

31 Claims, 7 Drawing Sheets

| Segment | Offset | Slope |
|---|---|---|
| 1 | -500 | 3 |
| 2 | 250 | 1.5 |
| 3 | 875 | 0.5 |

TRANSFER BELT IMAGE REGISTRATION CORRECTION, OPERATING PARAMETERS AND LIFE VIA STORED PARAMETERS

CROSS REFERENCE TO RELATED APPLICATIONS

This application is a continuation-in-part of U.S. patent application Ser. No. 09/398,617 filed Sep. 17, 1999, U.S. Pat. No. 6,198,897

BACKGROUND OF THE INVENTION

In color printers a plurality of color planes are sequentially aligned and deposited onto a transfer media such as a transfer belt. The transfer belt is then used to transfer the accumulated color planes to a piece of paper or other media. A problem associated with this process is misregistration or misalignment of one or more of the color planes. Alignment of the color planes and optimization of the transfer is crucial in achieving a high quality image. Due to the fact that each individual color plane is transferred onto the belt or paper at different locations along the travel path of the transfer belt, variations of the transfer quality and positioning of the belt within the travel path must be compensated for with a high degree of precision.

There are many instances where position variations and transfer quality variations can develop and cause a concomitant degradation in the resulting image. Factors such as variations in the width of the belt, the belt tension, and the belt resistivity are examples of factors that lead to transfer quality and belt position variations. It would be desirable to have a method and apparatus that compensates for variations within a printer which is inexpensive to implement and does not add complexity to the printer.

BRIEF SUMMARY OF THE INVENTION

A method and apparatus for providing transfer quality optimization in printers is disclosed. A transfer belt subassembly includes a transfer belt and a storage device. The transfer belt also includes a home position indicator. The transfer belt subassembly is measured and characterized relative to the home position indicator before being installed in a printer. The measurement and calibration data for the transfer belt is then stored in the storage device that is part of the transfer belt subassembly. When the transfer belt subassembly is inserted into a printer, a controller within the printer is placed in communication with the storage device. A sensor is used to determine the home position of the transfer belt from the indicator, and a resulting signal indicating when the belt is at the home position is provided to the controller. The controller utilizes the measurement and calibration data from the storage device to provide correction with respect to each color station of the color printer, taking into account and compensating for variations in the transfer belt subassembly. In such a manner, the measurement and calibration data is predetermined before the transfer belt subassembly is inserted into the printer, thereby simplifying the printer composition. By use of the calibration and measurement data, precise alignment of the color planes with respect to one another is achieved, and the proper electrical transfer setting suited to that belt is obtained for improving transfer quality.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Color printers typically utilize a transfer belt assembly to accumulate an image from a plurality of color planes. The color planes are placed onto the belt in succession as the transfer belt passes by the photoconductive (PC) drum associated with each color station. Once the belt has traversed all of the PC drums a resulting image, which will later be transferred to a print medium, is provided on the transfer belt. Alternatively, the transfer belt is used to transport a piece of print medium, such as paper, card stock, or transparencies, and the color planes are deposited directly onto the print medium as the medium passes by the PC drums of each color station.

Figure 1:
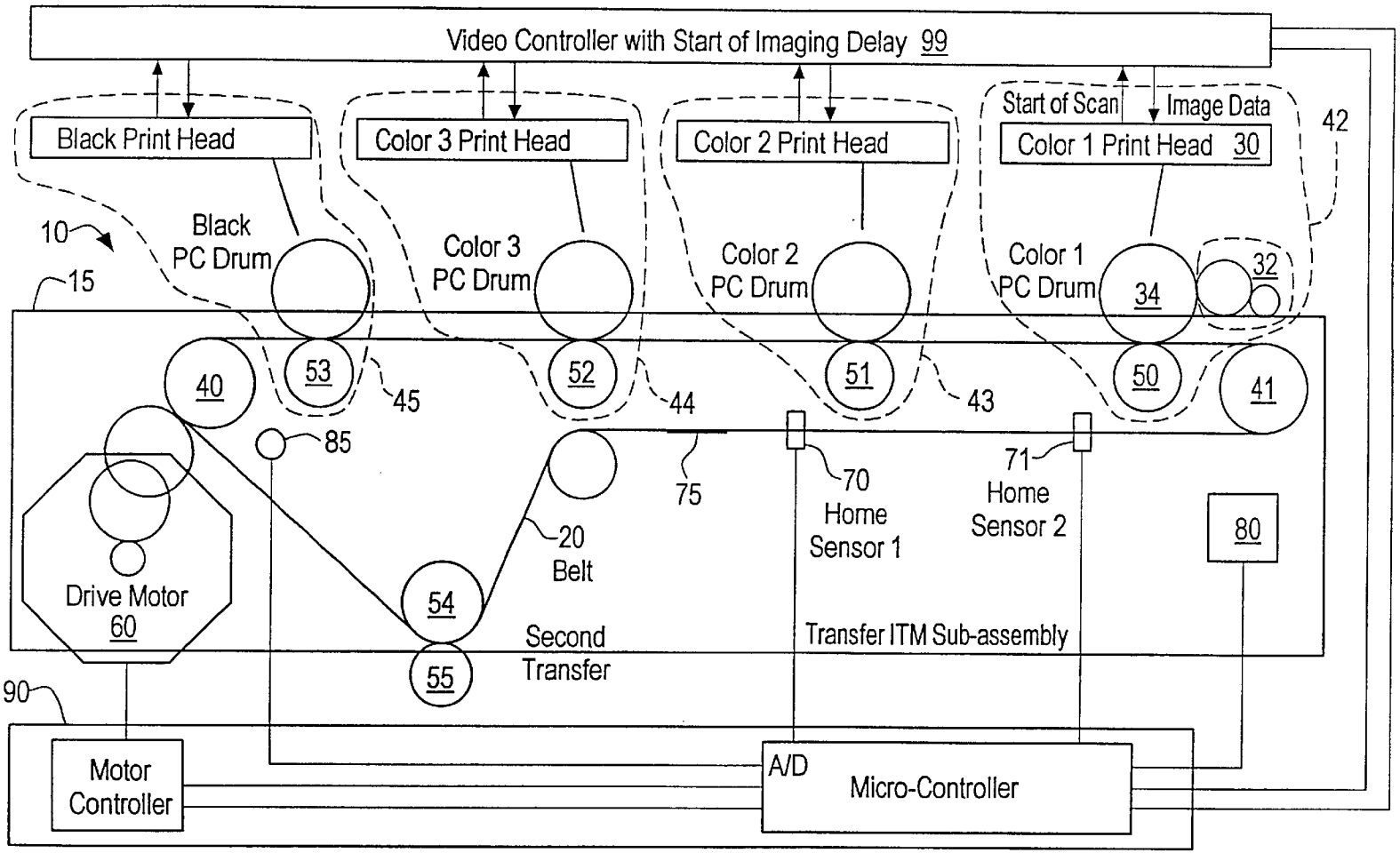
FIG. 1 is a diagram illustrating the apparatus of the present invention wherein the image is accumulated on an intermediate transfer member (ITM).

Referring to FIG. 1, a preferred embodiment of an apparatus 10 for compensating for transfer belt positioning variations, transfer quality variations, belt resistivity and transfer roll resistivities, which may vary from subassembly to subassembly, is shown. While the preferred embodiment refers to a printer, it should be appreciated that the present invention relates to any image forming apparatus. The apparatus 10 includes a transfer belt subassembly 15, a controller 90 and color stations 42–45. Each color station pertains to a different color plane. In this embodiment color station 42 is utilized for providing a yellow (Y) color plane, color station 43 for providing a cyan (C) color plane, color station 44 for providing a magenta (M) color plane and color station 45 for providing a black (K) color plane. Other embodiments may have different numbers (one or more) of color stations.

Each of the color stations includes a print head 30, a developer assembly 32 and a PC drum 34. (This detail is shown only for color station 42.) The print head 30 forms a latent image on the PC drum 34. Toner (not shown) is supplied to the PC drum via developer assembly 32 to produce a developed toned image, also known as a color plane, from the latent image on the PC drum. Each color station may be realized through any one of a plurality of prior art configurations of these elements.

Figure 2:
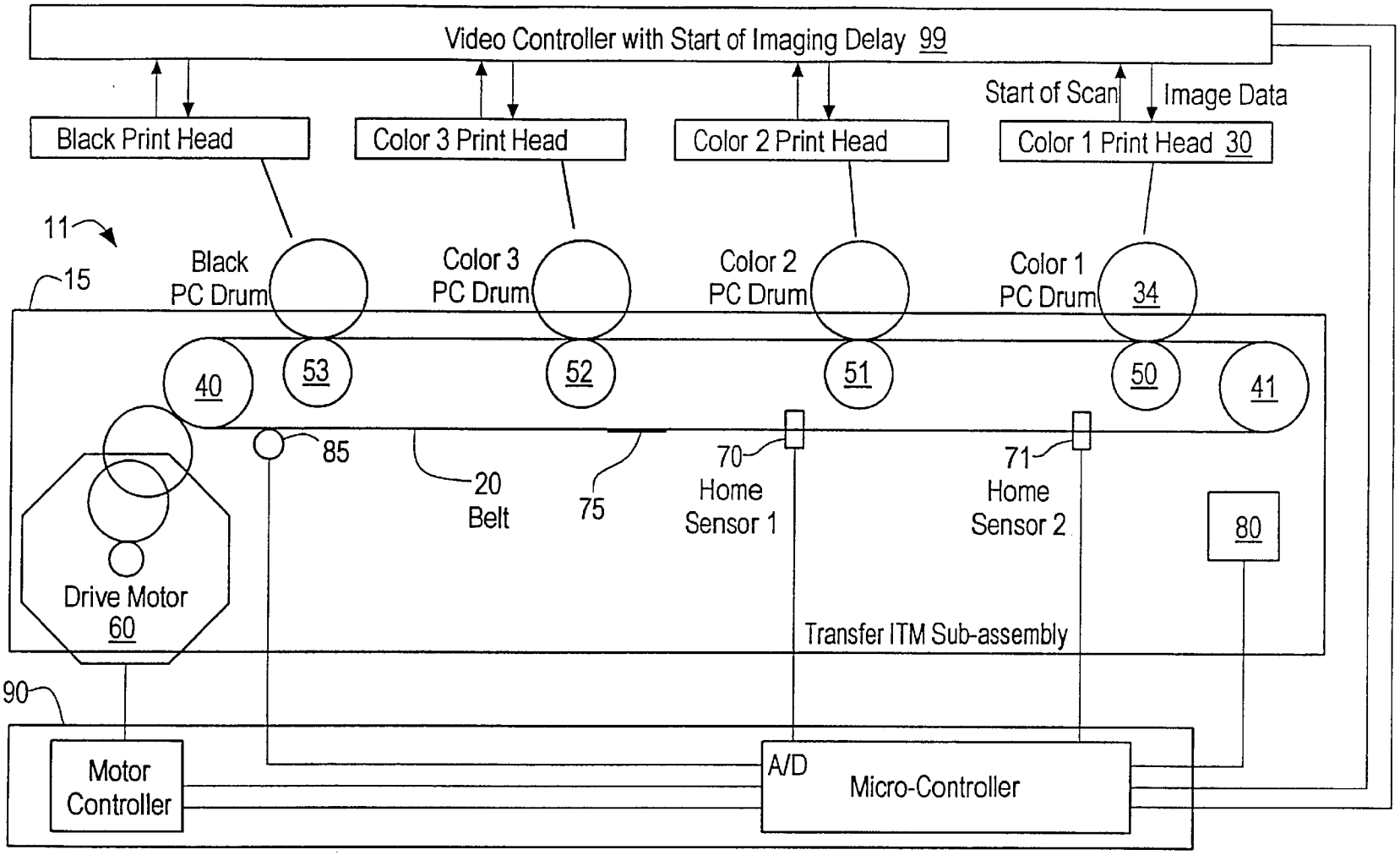
FIG. 2 is a diagram illustrating the apparatus of the present invention wherein the image is accumulated on a print medium.

The transfer belt subassembly 15 contains a transfer belt 20, one or more home position sensors (70 and 71), a memory device 80 and a plurality of rollers. As shown in FIGS. 1 and 2, the transfer belt is disposed about, or adjacent to, said rollers. The plurality of rollers include an end roller 41 (also referred to as a tension roller), a drive roller 40, a first transfer roller 50, a second transfer roller 51, a third transfer roller 52, and a fourth transfer roller 53. (Note: A transfer roller is one category of a transfer member, discussed further hereafter.) The accumulated image is then transferred to a print medium (not shown) by transfer roller 55, which is adjacent to said transfer belt. Depending upon the embodiment, other rollers may be useful or necessary. It should be appreciated that other embodiments not including transfer rollers may also be utilized. Referring to FIG. 2, a second embodiment of an apparatus 11 for providing transfer belt correction is shown. The apparatus 11 is similar to the apparatus disclosed in FIG. 1, except that the color planes are directly deposited onto a print medium disposed upon and transported by the transfer belt.

In the simplified embodiment of FIG. 2, the transfer belt 20 surrounds and traverses an ellipsoidal path defined by rollers 40 and 41. The transfer belt 20 also includes a home position indicator 75 that is useful for accurately identifying a specific position of the transfer belt 20 with respect to the transfer belt subassembly 15. The home position indicator 75 of the transfer belt 20 provides a reference point for the measurement and calibration data. The indicator 75 may be realized as a hole punched in the transfer belt 20 or as indicia printed or painted on the belt. The indicator 75 may also be realized as a magnetic or an electrostatic device. While the home position sensor 70 is shown as part of the subassembly 15 in this embodiment, the home position sensor 70 could also be located external to the subassembly 15. The home position sensor 70 must be able to detect the presence of the home position indicator 75. Thus, when the home position indicator 75 comprises a hole punched in the transfer belt 20, an optical sensor may be used to detect the presence of the hole. When painted or printed indicia are used to indicate the home position a reader must be used to sense the presence of the indicia. Similarly, when a magnetic or electrostatic device is used as the home position indicator a sensor sensitive to the magnetic or electrostatic device is used to determine the presence of the home position indicator 75.

Roller 40 is used as a drive roller and is in mechanical communication with a drive motor 60. Roller 40 thus provides for movement of the transfer belt 20 through the belt path.

Alignment of the color planes on the transfer belt is crucial for providing a high quality resulting image. There are a number of factors that affect the alignment of the color planes on the transfer belt. For example, there may be variations in the thickness or width of the belt as well as variations in the tension of the belt along the belt path. In the second embodiment, the print medium may move with respect to the transfer belt. In addition, both the mechanical and the electrical parameters of belts may vary around the belt circumference and on average between subassemblies.

The object of this invention is to provide an intermediate transfer member (ITM) subassembly for a color EP printer that functions as a modular subassembly in which characterization data critical to function is measured at time of manufacture and stored in a memory device affixed to the ITM subassembly. Characterization data includes belt resistivity range for transfer current/voltage adjustment; transfer roll resistivity; surface velocity profile for drive velocity correction (primarily due to belt thickness variation); and belt tracking profile for correction of image position perpendicular to the direction of belt travel. The characterization data is accessible to the machine into which the ITM subassembly is installed, enabling the machine microcontroller to provide proper operating points for transfer quality, feed-forward velocity control for process direction registration of color planes, and imaging start of scan delays for scan direction registration of color planes. Additional information stored at time of manufacture may include: a) date of manufacture of component parts, b) source of component parts, c) diameters of drive and idler rolls, d) belt length, e) belt tension, f) drive motor initialization values, g) allowable lifetime in cycles, and h) EC level. A unique serial number or bit pattern is recorded in the memory either as received from the memory component supplier or at time of manufacture for identification and possible lockout of unauthorized subassemblies. The information stored at time of manufacture is write protected against later, unauthorized modification. Data is stored in a form readily accessible to the machine controller—in a tabular format.

Remaining memory is allocated for use while the ITM subassembly is installed in the color EP machine. The machine writes number of cycles of use into the memory so that overall usage of the subassembly can be tracked. The machine displays an end of life warning and may force an end-of-life lockout based upon this recorded cycle count. Life is recorded in the preferred embodiment by burning bits in a sequence of memory locations—in which each bit represents nominally 1000 cycles and total life is 255K cycles, thus consuming 255 bits of memory plus a lockout bit. Page count and job count may be similarly recorded as other ways of accessing subassembly life.

As described above, this invention serves multiple functions, as exemplified by the function of the Memory device affixed to ITM subassembly: (See 80 in FIG. 1.)

a) Stores serial number and bit pattern enabling the machine to recognize an authorized unit and to lock out an unauthorized unit.

b) Stores information about the ITM subassembly used by the machine for control.
   - i) OEM ID
   - ii) ITM subassembly EC Level
   - iii) Belt length in zones for velocity control
   - iv) Belt length in zones for start of imaging control
   - v) Belt cycle end-of-life limit
   - vi) Belt pages end-of-life limit
   - vii) Belt job count end-of-life limit
   - viii) Belt DC time between sensors vs. temperature relationship
   - ix) Time between sensors for 108.21 mm/sec at 30° C. with AC feed-forward
   - x) Time between sensors for 108.21 mm/sec at 30° C. without AC feed-forward
   - xi) Function enable: 1) cycle lockout, 2) page lockout, 3) job lock-out, 4) DC velocity correction enable, 5) AC velocity feed-forward enable, 6) start of scan delay feed-forward enable, 7) transfer offset enable.

c) Stores details of components which comprise the ITM subassembly. This is of an information nature; and not used by the machine for control purposes.
   - i) Date of manufacture of ITM subassembly
   - ii) Date of manufacture of component parts
   - iii) Source of component parts
   - iv) Diameters of drive and idler rolls
   - v) Belt length
   - vi) Belt tension d) The preferred memory, the DS 1985, has a write protection feature to protect data written at time of manufacture against unauthorized modification.

e) Has memory allocated for use while the ITM subassembly is operated in the associated color EP machine to track life cycles, pages and jobs. Here, cycles can be recorded by burning one bit for every 1000 cycles, consuming 255 bits of memory to tally 255K cycles, with one bit remaining as a lockout bit. Pages and jobs are tallied in the same way.

f) Has an end-of-life lockout feature to prevent further operation once cycles, pages, or jobs, or a combination thereof, has exceeded an allowable criterion.

g) Stores transfer operating point data either as a modification to the setpoint (preferred) or as a complete setpoint table to provide best print quality when the ITM assembly is operated in the associated color EP machine.

h) Stores process direction velocity characterization data in a format that allows the machine microcontroller to correct velocity errors that affect color plane registration in the process direction.

i) Stores lateral or "scan direction" (perpendicular to process direction) belt tracking characterization data in a format that allows the machine microcontroller to correct for tracking errors that affect registration of color planes in the scan direction relative to black.

In order to compensate for variations in the belt the transfer belt subassembly 15 is measured and characterized in a special test fixture at the time the subassembly 15 is manufactured. The data that reflects the measured and characterized transfer belt subassembly 15 is stored in a storage device (also called an integrated circuit) 80, which is part of the belt subassembly 15. The storage device 80 may be a semiconductor memory such as a DS1985 non-volatile and one-time programmable 16K bit memory available from Dallas Semiconductor Corp. of Dallas, Tex. The stored data is also referred to as calibration data.

Other non-volatile memories that can be used include the Dallas Semiconductor DS1982, 1K bit Add-Only memory that can be used only if a subset of the disclosed functions are implemented and memory is conservatively managed. Larger memory devices and conventional EPROMS, EEPROM and NVRAM memories with read/write capabilities can be used with loss of write protection at time of manufacture and possible (unauthorized) resetting of the subassembly life-tracking bits.

Figure 7:
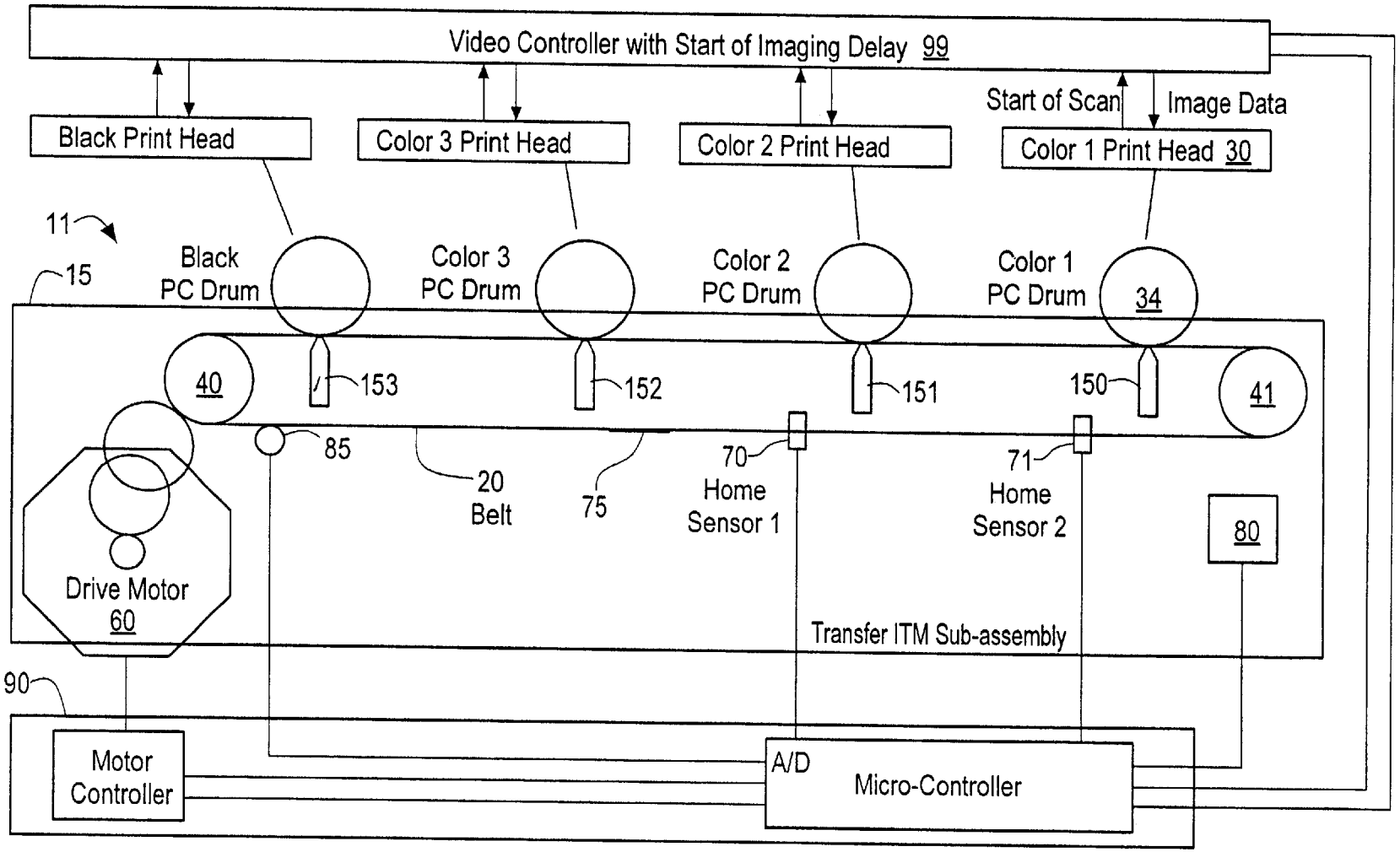
FIG. 7. is a diagram illustrating the apparatus of the present invention wherein the image is accumulated on a print medium using "plate-like" transfer members.

In a first embodiment, the system includes four imaging stations. The system may also include a transfer station for transferring the image from the belt to a print medium. The term transfer station is used here to define both (1) the location where the black or color belts transfer images to the transfer belt (sometimes referred to hereafter as first transfer stations) and (2) the location where the image is transferred from the transfer belt to the print medium (sometimes referred to hereafter as the second transfer station). Each imaging station includes an image bearing member, which may be a photoconductive (PC) drum, an optical source such as a laser assembly operative to produce latent images on the image bearing member, a toner source, and a developing member operative to produce developed toned images from the latent image on the image bearing member. An electrically biased first transfer member is associated with each imaging station. The transfer members, which are disposed adjacent to each image bearing member, are operative in conjunction with the image bearing member upon application of the appropriate voltages to transfer toner from the image bearing member to a substrate passing through the nip between the image bearing member and the transfer member. Servo operations are used to set the operating voltages on each of the transfer members at first transfer. Variations in first transfer members include, but are not limited to, (1) transfer rolls and (2) "plate-like" transfer members that have rubbing contact rather than rolling contact at the first transfer stations. Transfer rolls typically comprise a supporting steel shaft 6 to 8 mm in diameter with a 3 to 6 mm thick layer of resistive urethane or EPDM foam that is molded or bonded with an electrically conductive path to the supporting shaft. Foam resistivity is typically $10^6$ to $10^{10}$ ohm-cm and foam durometer is typically 25 to 80 Shore 00. Other shaft materials and foam materials and thicknesses are also possible. Plate-like transfer members (150, 151, 152, 153 of FIG. 7 ) that may be used in place of rollers at first transfer include resistive urethane blades and resistive fiber brushes which have a stiffness sufficient to press the transfer belt into contact with the photoconductor drum with a force in the range of 10 to 100 g/cm. Material resistivity is chosen to produce a voltage drop of 1 to 400 volts through the plate-like member when a current of 0.5 uA/cm is passed through the plate-like transfer member.

In operation, to transfer toner from the PC drum 34 to the transfer belt 20 at the first transfer assembly, the rotating PC drum surface is charged by a charging assembly. Portions of the drum surface are selectively discharged by the optical energy from a laser, LED array, or the like. Toner is transferred to the drum as determined by the pattern of charge on the drum and as developed by a developing assembly. The developed toner is then transferred to the transfer belt 20 at the nip between the PC drum 34 and the transfer roller 50. To effect the movement of the toner to the ITM belt, a high voltage power supply 68 (not shown) is electrically connected to each transfer roller shaft to apply a voltage to the transfer roller opposite in polarity to the charge on the toner. Alternatively, the high voltage power supply can be in the form of (1) a plurality of power supplies, one being for each transfer roll or (2) a single high voltage power supply shared among the first transfer rolls. There may be an independent high voltage power supply for the second transfer roll, said power supply possibly having a larger voltage range to handle a wide variety of media. Another alternative could be the combining of the power supply for the second transfer roll with that of one or more of the first transfer rolls (e.g., the black color roll). Other combinations are also possible. Preferably, there is an independent power supply for the second transfer roll. To aid in the transfer of the toner, a velocity difference between the PC drum and the ITM belt is optionally utilized to agitate the toner and improve the transfer efficiency. The velocity difference is between −2.5% and +2.5%, but is nominally 0% in the preferred embodiment. Any suitable controller 90 controls all operations.

The transfer belt 20 is nominally neutral in charge as it enters the first color PC/transfer roller nip. However, it may have a tribo-electrically generated charge from the feed process or a slight residual charge remaining from a previous revolution. Charged areas on the PC drum are at nominally −1000 V and discharged (toner-covered) areas at nominally −340 V. The PC drum core is at −200 V.

When the leading edge of the PC image arrives at the nip between the PC drum 34 and the transfer roller 50, the transfer "image" voltage is applied to the transfer roller shaft. Immediately prior to the end of the PC image exiting the nip, the transfer "inter-image" voltage is applied to the transfer roller shaft. This timing applies the transfer "image" voltage only to the image areas of the PC drum. Non-imaged areas see only the "inter-image" transfer voltage that is set to minimize toner transfer and to avoid excess current flow.

The transfer operating points are defined for each transfer of the image to and from the belt. The transfer operating points include the transfer voltage and current limits. The operating points may be changed to reflect differences in the belt resistivity in order to produce an optimal image. The printer includes a setting for low, normal, and high modes. The characterization data also includes a low, normal and high mode. The following table reflects the setting achieved by the mode selected in the printer in conjunction with the mode stored as part of the characterization data.

| Transfer Setting | Memory device | | |
|---|---|---|---|
| Machine mode | 01 = low | 00 = normal | 10 = high |
| Low | Low | Low | Normal |
| Normal | Low | Normal | High |
| High | Normal | High | High |

Thus, if the machine is set to low mode, and the characterization data from memory device indicates a 01 for low, the operating points will be set to their low values. If the memory device indicated a 00 for a normal setting while the machine is in the low mode, the operating points would again be set low. However, if the machine was set to low mode and the memory device indicates a 10 for high, the operating points would be changed to their normal setting. Accordingly, the mode of the machine may be further adjusted by taking into account the appropriate characterization data pertaining to the transfer station.

As an alternative to storing a value that selects from among a plurality of transfer modes stored in the printer, the transfer operating characteristic for a particular transfer belt can optionally be stored in the memory device in a form that completely describes the transfer characteristic for that belt.

In another embodiment, which consumes substantially more memory in the ITM, a complete set of transfer tables are contained in the ITM memory and made available to the machine controller. In contrast to the first embodiment that stores a low, normal, or high selection value that is used to select operating modes or offsets from tables stored in machine memory, the second embodiment stores the actual transfer control tables in the ITM memory. This second embodiment provides for significant differences in ITM transfer performance that can arise from multiple causes, including 1) change in ITM belt materials or supplier, 2) change in first transfer roll material, or 3) replacement of the first transfer rollers with lower-cost plate-like transfer members. Transfer operating data can also be provided in the form of an algorithm.

The machine that associates with the ITM module and attached memory uses a transfer servo process to compensate for shifts in the electrical properties of transfer rolls at $1^{st}$ and $2^{nd}$ transfer, the ITM belt, and the photoconductor drum coatings. Changes in the electrical properties of these elements arise as a result of temperature and humidity changes, mechanical wear, and electrical fatigue. To maintain high transfer efficiencies and good print quality, the transfer roll operating voltage needs to be adjusted to compensate for these changes. The process of determining the operating voltages at $1^{st}$ and $2^{nd}$ transfer is termed a servo process. A servo voltage is determined for each transfer roll as that voltage on the transfer roll shaft which delivers a fixed current of nominally 8 $\mu$A to the ITM belt and supporting photoconductor (PC) drum at $1^{st}$ transfer or to the ITM belt and supporting backup roll at $2^{nd}$ transfer. Each PC drum is charged to a predetermined surface potential of nominally −500 volts during the transfer servo process with the PC core potential at −200 volts. The ITM backup roll surface is set to nominally −600 volts during the servo process. The operating voltage applied to the shaft of each transfer roll during the printing process is calculated via a corresponding pre-determined transfer characteristic from the servo voltage. The transfer characteristic is stored in table form in machine memory or in the ITM memory. When the tables are stored in ITM memory, they may be read into machine memory and stored for rapid access.

A slope and offset representation of the transfer characteristic at each of the four color 1st transfer stations and a slope and offset representation of the 2nd transfer characteristic by media type and print mode (e.g. simplex/duplex) are provided in this implementation. An additional set of table entries is required for each significantly different machine process speed. The table values for a single color could be used in place of table values for the four individual colors at 1st transfer if toner charge/mass and belt initial conditions were similar at each of the four stations.

In the preferred embodiment, one set of tables is provided for transfer at 108 mm/second process speed and a second set for transfer at 4 mm/second. A total of eight tables are thus provided at $1^{st}$ transfer for the four color stations at two process speeds. A total of 20 tables are provided at $2^{nd}$ transfer for ten media types and print modes at two process speeds.

Figure 3:
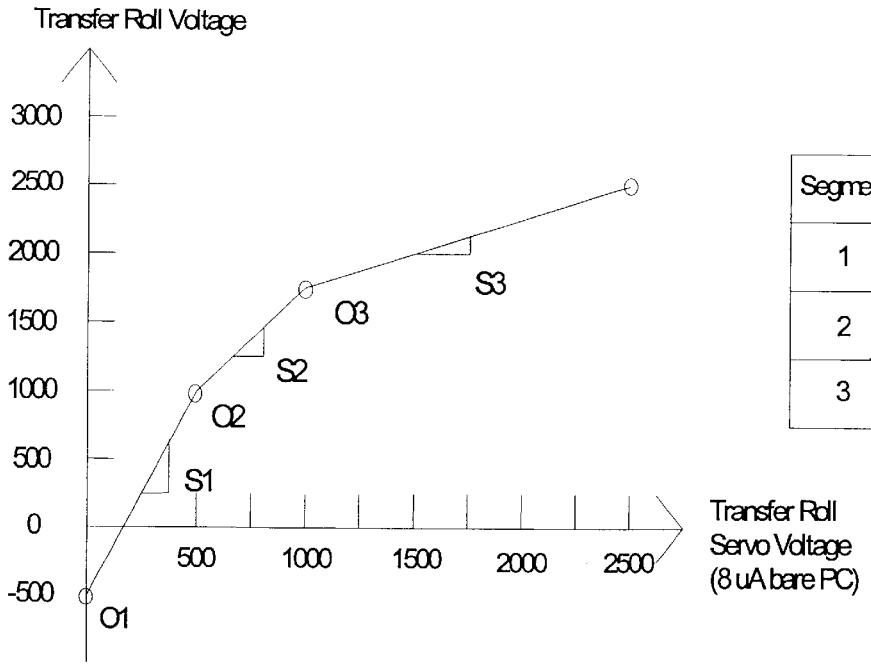
FIG. 3 shows a typical transfer operating characteristic curve that can be included in the ITM memory.

An example of the parametric representation of a transfer characteristic is shown in FIG. 3. Here, each transfer characteristic is represented using an offset and a slope value for each of 3 line segments. The horizontal axis represents the transfer servo voltage required to produce an 8 $\mu$A servo current as previously described. The vertical axis represents the voltage applied to the transfer roll shaft during printing. The transfer servo slope breakpoints on the horizontal axis corresponding to 02 and 03 in FIG. 3 are common to all four $1^{st}$ transfer tables and to $2^{nd}$ transfer. Each of the six numerical values representing the slope and offsets for the three line segments is stored in an 8-bit byte; the transfer roll operating offset voltage is represented in 25 volt increments and slope is represented in 64th's. Each transfer characteristic thus consumes 48 bits of ITM memory.

The table values corresponding to a 108 mm/second process speed at each of the four $1^{st}$ transfer color stations and at $2^{nd}$ transfer for standard 20 pound paper media and transparencies are given in Table 1. Offsets are given relative to the −200 volt photoconductor drum core at $1^{st}$ transfer and relative to the −600 volt ITM back up roll surface potential at $2^{nd}$ transfer.

TABLE 1

A) Offset Voltage and Multiplier Representation of 1st and 2nd Transfer Characteristics

| | | Servo Range | | | | | |
|---|---|---|---|---|---|---|---|
| | | 0 to 500 volts | | 500 to 1000 volts | | 1000 to Max output | |
| Transfer Station | | O1 | S1 | O2 | S2 | O3 | S3 |
| 1st Transfer | Yellow | 28 | 0.8 | 28 | 0.8 | 28 | 0.8 |
| 1st Transfer | Cyan | 100 | 0.8 | 100 | 0.8 | 100 | 0.8 |
| 1st Transfer | Magenta | 200 | 0.8 | 200 | 0.8 | 200 | 0.8 |
| 1st Transfer | Black | 300 | 0.8 | 300 | 0.8 | 300 | 0.8 |
| 2nd Transfer | 20# Paper Simplex | −96 | 2.8 | 454 | 1.71 | 1148 | 1.02 |
| 2nd Transfer | Trans-parency | 0 | 2.24 | 520 | 1.2 | 1092 | 0.63 |

TABLE 1-continued

B) 1-Byte per Entry Representation of 1st and 2nd Transfer Characteristics (decimal) 25 volts per bit Offset, signed integer, −3200 to +3175 volts; 1/64th's per bit Slope, unsigned integer, 0 to 3.98 multiplier

| | | Servo Range | | | | | |
|---|---|---|---|---|---|---|---|
| | | 0 to 500 volts | | 500 to 1000 volts | | 1000 to Max output | |
| Transfer Station | | O1 | S1 | O2 | S2 | O3 | S3 |
| 1st Transfer | Yellow | 1 | 51 | 1 | 51 | 1 | 51 |
| 1st Transfer | Cyan | 4 | 51 | 4 | 51 | 4 | 51 |
| 1st Transfer | Magenta | 8 | 51 | 8 | 51 | 8 | 51 |
| 1st Transfer | Black | 12 | 51 | 12 | 51 | 12 | 51 |
| 2nd Transfer | 20# Paper Simplex | −4 | 179 | 18 | 109 | 46 | 65 |
| 2nd Transfer | Trans-parency | 0 | 143 | 21 | 77 | 44 | 40 |

Figure 4:
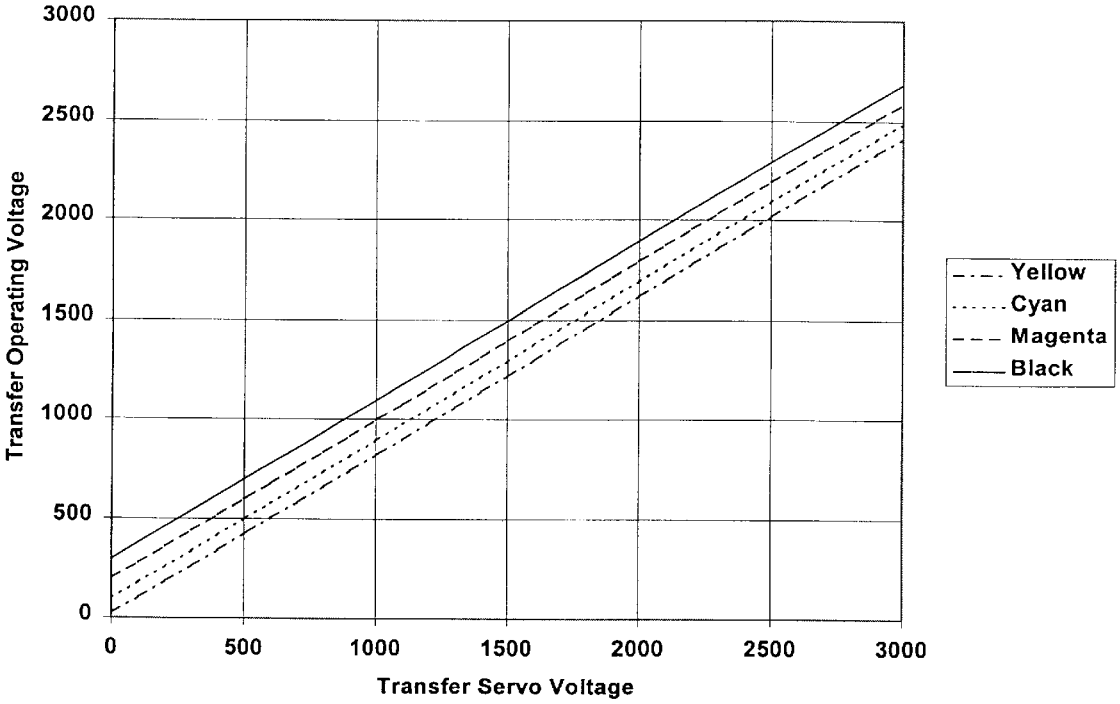
FIG. 4 is an example of a graphical representation of the transfer characteristics for 4 colors at the $1^{st}$ transfer stations.
Figure 5:
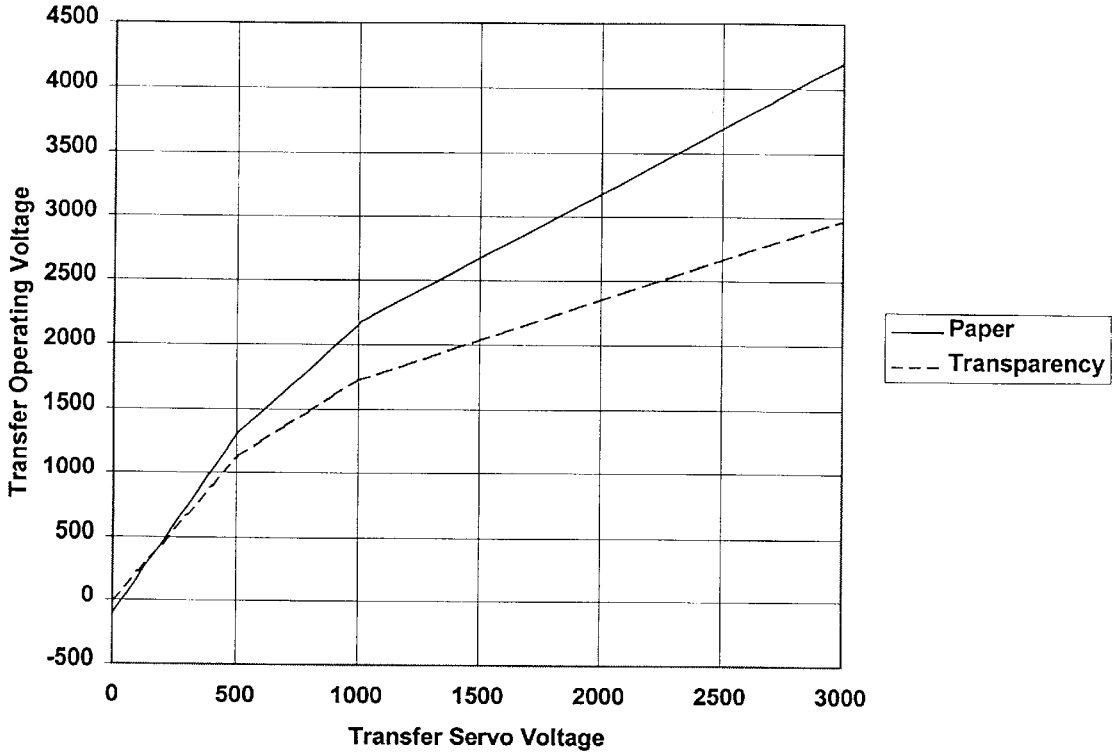
FIG. 5 is an example of a graphical representation of the transfer characteristics for 2 media at the $2^{nd}$ transfer station.

The tabular representation of the $1^{st}$ transfer characteristics from Table 1 A) is shown in graphical format in FIG. 4. Because the slope values for all four color stations are constant across all servo ranges, no breakpoints are visible in FIG. 4. The tabular representation of the 2nd transfer characteristics from Table 1 A) is shown in graphical format in FIG. 5.

Table 1B) duplicates Table 1A) with values shown in the 1 byte per entry format in which they are stored in the semiconductor memory.

The machine transfer control algorithm may also be parametrically altered based upon the ITM cycle count tallied (by cycles or pages) during the life of the ITM.

A map of the memory contents for one embodiment is shown below:

TABLE 2

| Page | Bits | Description |
|---|---|---|
| 0 | 256 | Reserved for Uniqueware component ID |
| 1 | 256 | OEM ID<br>Belt cycle end-of-life limit<br>Belt pages end-of-life limit<br>Belt job count end-of-life limit<br>Time between sensors for 108.12 mm/sec at 30° C. with AC feed-forward<br>Time between sensors for 108.12 mm/sec at 30° C. without AC feed-forward<br>Belt DC time between sensors vs. temperature relationship (2 byte slope and offset)<br>Belt length in zones for velocity control<br>DC Velocity Count to set 108.12 mm/sec belt surface velocity at 30° C.<br>AC Velocity Count, Initial Offset from DC count at Home Location (2 bytes, signed)<br>AC Velocity Count, Number of steps (Ns) per table increment (4 lsb's of byte)<br>Start of Scan, Initial Offset for K, M, C, & Y (2 bytes each, unsigned)<br>Start of Scan, Number of slices (N) per table increment for K, M, C, & Y (1 or 2), 2 bits each<br>Reserved for Future Use (Calibration Motor Halls/Rev, FG's/Rev, Ref Clock)<br>Function enable (1 bit each): 1) cycle lockout, 2) page lockout, 3) job lock-out, 4) DC velocity correction, 5) AC velocity feed-forward, 6) Start of Scan Delay feed-forward, 7) transfer offset enable, 8) transfer table enable |
| 2 | 256 | Page locked at time of manufacture (if Dallas Semiconductor i-Button)<br>ITM subassembly EC Level<br>Date of manufacture of ITM subassembly<br>Date of manufacture of component parts<br>Source of component parts<br>Diameters of drive and idler rolls<br>Belt tension, Belt length<br>Page locked at time of manufacture |
| 3 | 256 | ITM subassembly cycle tally @ 1000 cycles per bit = 255K cycles max + lockout bit |
| 4 | 256 | ITM subassembly page tally @ 1000 pages per bit = 255K pages max + lockout bit |
| 5 | 256 | ITM subassembly job tally @ 1000 jobs per bit = 255K jobs max + lockout bit |
| 6–8 | 512 | Transfer operating point offsets <u>or</u> complete transter tables, 1st transfer PC's to belt<br>Transfer Offset Table, 2 bits per Color, 00 or 10 = Normal, 01 = High, 11 = Low<br>Transfer table for each color at 1st transfer at 1 byte per constant:<br>[Slope breakpoints at full speed (2 bytes), Slope breakpoints at ½ speed (2 bytes)]<br>[Offset 1, Slope 1, Offset 2, Slope 2, Offset 3, Slope 3]<br>4 Tables for 1st transfer (4 colors) at full speed; 4 tables at ½ speed operation<br>Pages locked at time of manufacture. |
| 8–11 | 1024 | Transfer operating point offsets <u>or</u> complete transfer tables, 2nd transfer belt to media<br>Transfer Offset Table, 2nd Transfer, 2 lsb's: 00 or 10 = Normal, 01 = High, 11 = Low<br>Transfer table for each media type at 1st transfer at 2nd transfer<br>[Slope breakpoints at full speed (2 bytes), Slope breakpoints at ½ speed (2 bytes)]<br>[Offset 1, Slope 1, Offset 2, Slope 2, Offset 3, Slope 3]<br>10 Tables for 10 media types at full speed; 10 tables for 10 media types at ½ speed<br>Pages locked at time of manufacture. |
| 12–21.375 | 2656 | Belt AC velocity correction, serial correction with respect to home hole 2 bits/zone, up to 1328 zones; Ns speed change steps per encoded increment/decrement<br>Correction Table: 00 or 10 - no change; 01 = +Ns steps; 11 = −Ns steps (~0.01% per step)<br>Plan of Record: 1264 zones of ~0.703 mm each, pages locked at time of manufacture |
| 21.375–31.75 | 2656 | Belt Black-Ref Delay to image serial correction table 2 bits/zone, up to 1328 zones;<br>N slices per encoded increment/decrement (1 or 2 slices where 1 slice = 1/7200 inches)<br>Correction Table: 00 or 10 = no change; 01 = +N slices; 11 = −N slices<br>Plan of Record: 1264 zones of 16.9 scans each at 600 dpi (889 mm); locked at mfg |
| 31.75–42.125 | 2656 | Belt Magenta-Ref delay to image serial correction table 2 bits/zone, up to 1328 zones;<br>N slices per encoded increment/decrement (1 or 2 slices where 1 slice = 1/7200 inches)<br>Correction Table: 00 or 10 = no change; 01 = +N slices; 11 = −N slices<br>Plan of Record: 1264 zones of 16.9 scans each at 600 dpi (889 mm); locked at mfg |
| 42.125–52.5 | 2656 | Belt Cyan-Ref delay to image serial correction table 2 1328 bits/zone, up to zones;<br>N slices per encoded increment/decrement (1 or 2 slices where 1 slice = 1/7200 inches)<br>Correction Table: 00 or 10 = no change; 01 = +N slices; 11 = −N slices<br>Plan of Record: 1264 zones of 16.9 scans each at 600 dpi (889 mm); locked at mfg |
| 52.5–62.875 | 2656 | Belt Yellow-Ref delay to image serial correction table 2 bits/zone, up to 1328 zones;<br>N slices per encoded increment/decrement (1 or 2 slices |

TABLE 2-continued

| Page | Bits | Description |
|---|---|---|
| | | where 1 slice = 1/7200 inches) |
| | | Correction Table: 00 or 10 = no change; |
| | | 01 = +N slices; 11 = −N slices |
| | | Plan of Record: 1264 zones of 16.9 scans each at 600 dpi (889 mm); locked at mfg |

The subassembly is a field replaceable unit. Thus a worn out subassembly can be easily replaced with another subassembly which also has its own stored calibration data. The printer can use the new subassembly, which has its own set of calibration data unique to the subassembly, to provide a high quality printed image.

Figure 6:
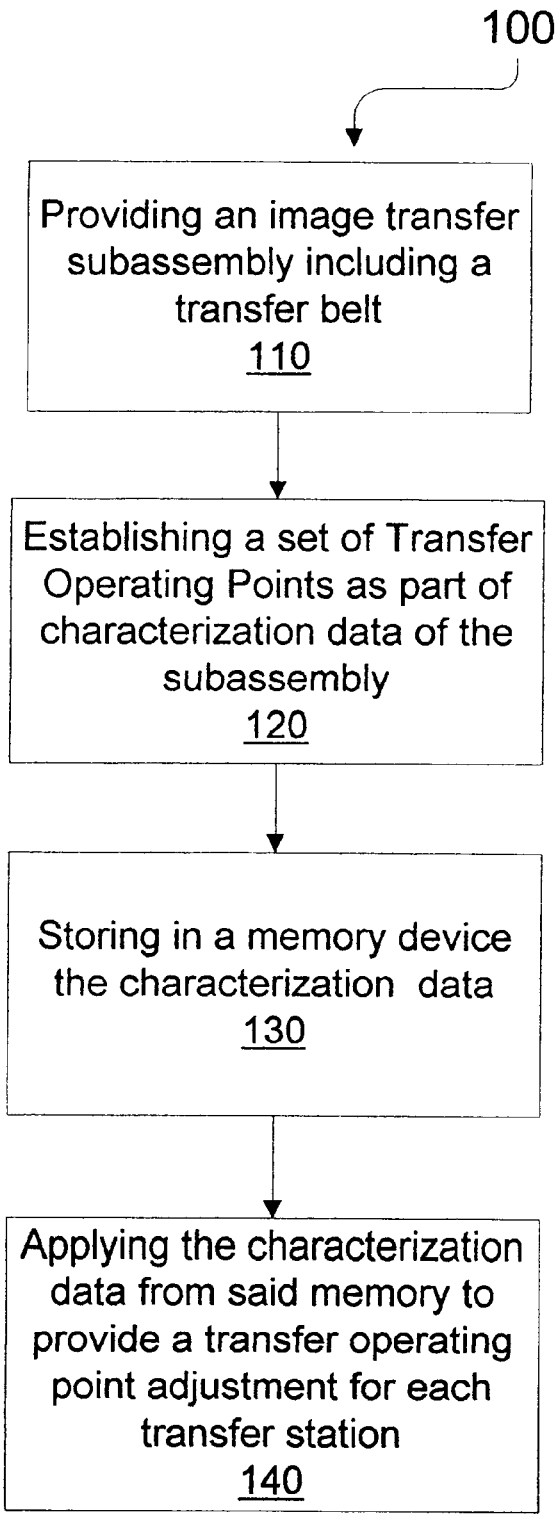
FIG. 6 is a flow chart illustrating the method of the present invention.

Referring now to FIG. 6, a flowchart showing a method 100 for providing transfer quality optimization of color planes deposited on a transfer belt is provided.

At a first step 110, an image transfer subassembly is provided. The subassembly includes a transfer belt and a memory device. The memory device is used to store characterization data particular to the subassembly.

The next step 120 establishes a set of Transfer Operating Points for each transfer station as part of the characterization of the subassembly. The Transfer Operating Points take into account differences in the belt and transfer roll resistivity and enable the machine microcontroller to adjust the power supply settings in accordance with variations in the belt and transfer roll resistivity.

At step 130 the characterization data is stored in the memory. Accordingly, the data remains with the subassembly such that when the subassembly is installed into a printer, the associated characterization data (which may be different for each subassembly) is also maintained with the subassembly.

Finally, at step 140, the characterization data is applied from the memory to the controller to provide the proper adjusting of the power supplies to take into account variations in the resistivity of the belt that may differ from subassembly to subassembly.

By way of the above described apparatus and method, errors associated with variations of the transfer belt subassembly are removed or significantly reduced. By including the memory device as part of the transfer belt subassembly, the transfer belt subassembly can be removed and a replacement subassembly installed while still maintaining a high precision of color plane registration and transfer quality on the transfer belt.

Having described preferred embodiments of the present invention it should be apparent to those of ordinary skill in the art that other embodiments and variations of the presently disclosed embodiment incorporating these concepts may be implemented without departing from the inventive concepts herein disclosed. Accordingly, the invention should not be viewed as limited to the described embodiments but rather should be limited solely by the scope and spirit of the appended claims.

I claim:

1. An apparatus for providing transfer quality optimization of color planes transferred to or from a transfer belt of an image forming apparatus comprising:

a removable subassembly comprising:

a plurality of transfer members;

a transfer belt disposed about or adjacent to said plurality of transfer members; and a storage device adapted to store data relating to said transfer belt and/or said plurality of transfer members;

a power supply in communication with said plurality of transfer members for providing at least one output to said plurality of transfer members, said at least one output for effecting said color plane transfer to or from said transfer belt; and a controller in communication with said storage device and said power supply, said controller operative to provide adjustments of said power supply in accordance with contents of said storage device.

2. The apparatus of claim 1 wherein said image forming apparatus comprises a printer.

3. The apparatus of claim 1 in which said power supply is in the form of a plurality of power supplies, each of said plurality of power supplies for providing a respective output to a respective one of said plurality of transfer members.

4. The apparatus of claim 1 in which said power supply is in the form of a single high voltage power supply for providing an output to each of said plurality of transfer members.

5. The apparatus of claim 1 wherein said plurality of transfer members comprise at least one first transfer member for transferring a respective color plane to said transfer belt and a second transfer member for transferring at least one color plane from said transfer belt to a medium.

6. The apparatus of claim 5 in which said at least one first transfer member is selected from the group consisting of (a) transfer rollers and (b) a plurality of plate-like transfer members.

7. The apparatus of claim 5 in which said data comprises at least one transfer characteristic for association with each said plurality of transfer members.

8. The apparatus of claim 7 in which said data comprises one or more types of data selected from the group consisting of transfer settings, transfer characteristics, complete transfer tables, and an algorithm for providing transfer operating data.

9. The apparatus of claim 8 in which said transfer characteristics are represented as a graphical relationship between a transfer roll servo voltage and a transfer roll voltage wherein said representation comprises slope and offset data for a plurality of line segments.

10. The apparatus of claim 9 in which said slope and offset data comprise slope and offset data for various combinations of media type, print mode and machine process speed.

11. The apparatus of claim 10 in which said process speed is 108 mm/sec or 54 mm/sec.

12. The apparatus of claim 8 in which said transfer characteristics comprise:

a. a respective slope and offset representation of the transfer characteristic at each of said at least one first transfer member; and b. a slope and offset representation of the transfer characteristic at said second transfer member by media type and print mode.

13. The apparatus of claim 8 in which said transfer setting is simplex/duplex or process speed.

14. The apparatus of claim 8 in which said algorithm is altered based upon a cycle count of the transfer belt.

15. The apparatus of claim 8 in which said transfer characteristics comprise transfer operating points.

16. The apparatus of claim 15 in which said transfer operating points comprise transfer voltage and current limits.

17. The apparatus of claim 15 in which said transfer operating points reflect differences in belt resistivity.

18. The apparatus of claim 15 in which said transfer operating points comprise printer mode settings and belt characterization data.

19. The apparatus of claim 18 in which said printer mode is selected from the group consisting of low, medium and high, and said belt characterization data is selected from the group consisting of low, medium and high.

20. The apparatus of claim 8 in which said at least one transfer characteristic correlates voltage applied to at least one of said transfer members with a servo voltage.

21. The apparatus of claim 20 in which said correlation results in a substantially fixed current flow from said transfer member during the servo operation.

22. The apparatus of claim 21 in which said substantially fixed current is nominally 8 $\mu$A.

23. The apparatus of claim 1 wherein said data is reflective of belt resistivity measurements.

24. The apparatus of claim 1 in which said controller modifies said data in response to changes in factors selected from the group consisting of temperature, humidity, mechanical wear, and electrical fatigue.

25. A method for providing transfer quality optimization of color planes transferred to or from a transfer belt of an image forming apparatus comprising the steps of:

providing a removable image transfer subassembly including a transfer belt disposed about or adjacent to a plurality of transfer members and a storage device;

determining calibration data relating to said transfer belt;

storing said calibration data relating to said transfer belt in said storage device associated with said removable image transfer subassembly; and controlling a power supply in communication with said removable image transfer subassembly in accordance with said calibration data from said storage device to achieve transfer quality optimization of color planes to or from said transfer belt.

26. The method of claim 25 wherein said image forming apparatus comprises a printer.

27. The method of claim 25 wherein said step of determining calibration data comprises determining transfer belt resistivity.

28. The method of claim 25 wherein said step of storing comprises storing said calibration data in a semiconductor memory.

29. The method of claim 28 in which said semiconductor memory is non-volatile.

30. The method of claim 29 in which said non-volatile semiconductor memory is one-time programmable.

31. A method for providing transfer quality optimization of color planes transferred to or from a transfer belt of a printer comprising the steps of:

providing a removable image transfer subassembly including a transfer belt disposed about or adjacent to a plurality of transfer rollers and a storage device;

determining calibration data relating to resistivity of said transfer belt and associated transfer rollers for said plurality of transfer rollers; and storing said calibration data in said storage device for subsequent use by a controller to control a power supply communicable with said plurality of transfer rollers.

* * * * *